US005616267A

United States Patent [19]

Brotz

[11] Patent Number: 5,616,267

[45] **Date of Patent: *Apr. 1, 1997**

[54] HIGH-TEMPERATURE ROLL MILL

[76] Inventor: Gregory R. Brotz, P. O. Box 1322, Sheboygan, Wis. 53081

[ * ] Notice: The term of this patent shall not extend beyond the expiration date of Pat. No. 5,294,766.

[21] Appl. No.: 382,134

[22] Filed: Feb. 1, 1995

Related U.S. Application Data

[63] Continuation-in-part of Ser. No. 204,858, Mar. 2, 1994, which is a continuation of Ser. No. 821,687, Jan. 16, 1992, Pat. No. 5,294,766, which is a continuation-in-part of Ser. No. 437,072, Nov. 15, 1989, Pat. No. 5,101,087.

[51] Int. Cl.[6] ..... H05B 6/14

[52] U.S. Cl. ..... 219/619; 219/469; 219/651; 162/207; 422/146

[58] Field of Search ..... 219/469, 619, 219/651; 162/207; 422/146; 165/89; 100/93 RP; 404/95, 122; 126/410, 270, 438; 355/3 FU

[56] References Cited

U.S. PATENT DOCUMENTS 5,101,087 3/1992 Brotz ..... 219/619
5,294,766 3/1994 Brotz ..... 219/619

*Primary Examiner*—Tu B. Hoang
*Attorney, Agent, or Firm*—William Nitkin

[57] ABSTRACT

A roll mill having a pair of thick, solid, heated rollers made of refractory material to heat materials to be mixed therebetween to a temperature in the range of approximately 500 degrees C. to 4000 degrees C.

10 Claims, 1 Drawing Sheet

HIGH-TEMPERATURE ROLL MILL

This application is a continuation-in-part of my previous application entitled Structure for High-temperature Mill Rolling of Compounds, Ser. No. 08/204,858 filed Mar. 2, 1994 now pending which was a continuation of my previous application under the same title, Ser. No. 07/821,687 filed Jan. 16, 1992, now U.S. Pat. No. 5,294,766 which application was a continuation-in-part of my previous application entitled Structure and Method of High-temperature Rolling Utilizing Fluidized Bed (as amended), Ser. No. 437,072 filed Nov. 15, 1989, now U.S. Pat. No. 5,101,087.

BACKGROUND OF THE INVENTION

1. Field of the Invention

The structure of this invention resides in the area of heated rollers and more particularly relates to a high-temperature roll mill for the melting and shearing of product having a high melting point temperature.

2. Description of the Prior Art

Conventional roll mills are well known in the art for mixing amounts of materials which are delivered into the nip of the rollers. Many of such roll mills are heated, for example, to melt resins to form a mixture and to blend such mass of materials forming a sheet around the rollers with a buildup of materials forming over the nip where great forces shear the materials together to form an homogenous mass. This type of mixing is highly desirable and is often superior to other forms of material mixing. Sheets that come off such rollers can be cut with a knife or directly deposited into molds. There are, though, limitations on the temperature level to which such prior art rollers can be heated.

SUMMARY OF THE INVENTION

It is an object of this invention to provide a roll mill to heat materials having very high melting point temperatures, such roll mill being constructed of thick, solid refractory rollers. The rollers of this invention heat the materials to be milled to the materials' very high melting point temperature to mix such materials by shearing in the nip between such rollers. One embodiment of the invention uses a pair of such rollers with one or both containing means to achieve high temperatures on the surface of each roller. In some embodiments the rollers can be heated with at least one electrical heating cartridge embedded therein. It is important in this invention that the roller material have a very high softening temperature so that during operation the rigidity of the rollers is maintained so that high melting temperatures can be achieved in such rollers as many of the compounds being mixed are glasses or other compounds which require very high temperatures in order to maintain such materials in a melted state for combination with other compounds. Further, such rollers can be operated in an atmospherically controlled chamber containing various gases and/or vapors as described below.

DESCRIPTION OF THE PREFERRED EMBODIMENT(S)

Figure 1:
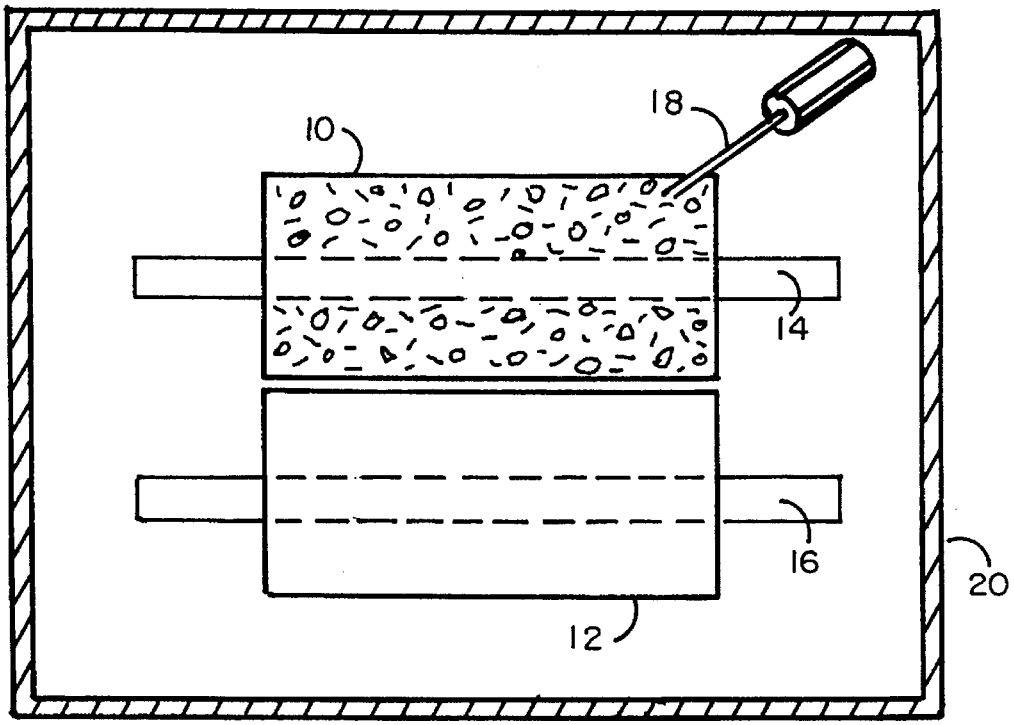
FIG. 1 illustrates a cross-sectional view of solid rollers heated by a heat beam within a chamber.

FIG. 1 illustrates a cross-sectional view of the refractory roll mill of this invention showing first roller 10 and second roller 12. The first and second rollers can be made in one embodiment solely of a thick, solid refractory ceramic material. The thickness of each roller is controlled by the function and size of the roller required in the roll mill whether it is a small roll mill for laboratory purposes or a larger roll mill for commercial purposes. The rollers can be made entirely of the refractory material except for their axles or channels therein if required as discussed below. Some ceramic refractory material is so strong even the axle of a roller can be unitarily formed of such refractory material with such roller. By use of the word "thick", it is meant that the vast bulk of the roller, and in some cases the entire roller, is made of the refractory material such that the roller is sufficiently strong to perform its work in a roll mill. First and second rollers 10 and 12 can reach the high temperatures of incandescence, being approximately 650 degrees C., sufficient to shear and melt the materials being mixed thereon by having a heat beam 18 directed thereon. In an alternate embodiment internal electric induction coils 38 or conventional heat cartridges 46 can be placed within the rollers to heat them to temperatures even higher than the onset of incandescent temperatures. By using induction coils, temperatures can be reached in the range of approximately 500 degrees C. to 4000 degrees C.

Some high-temperature refractory materials for roll mill construction are listed below:

| Compound | Melting Point |
|---|---|
| CaF | 1330 degrees C. |
| Vycor (96% sio) | 1550 degrees C. |
| Feo | 1560 degrees C. |
| Fused silica | 1710 degrees C. |
| $SiO_2$ | 1710 degrees C. |
| $Al_2O_3$ | 2050 degrees C. |
| $ZrO_2$ | 2700 degrees C. |
| MgO | 2800 degrees C. |
| TiC | 3190 degrees C. |
| Graphite | 3500 degrees C. |
| HfC | 3890 degrees C. |
| TaC | 4730 degrees C. |

These materials' melting points are just an indication of the useful operating temperatures of these types of rolls. Consideration of reactions occurring between the roll material and the materials being rolled has to be made. The physical properties of the material making up the rolls change as the temperature of the rolls approaches its melting point temperature. Due to the crystalline nature of refractory materials, the physical properties and integrity of the rollers can be maintained at operating temperatures heretofore not reached in the prior art. The usefulness of new materials that can be produced in such roll mills opens unexplored areas in material science.

Figure 2:
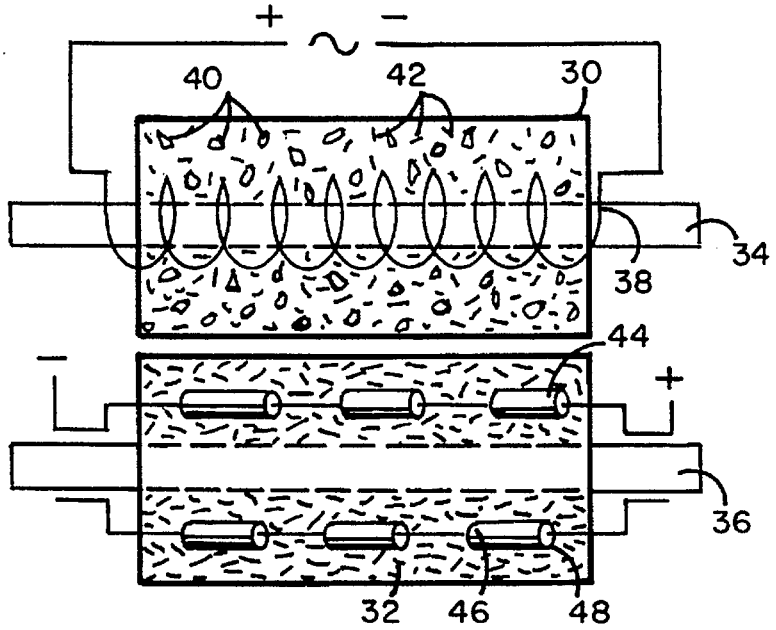
FIG. 2 illustrates a pair of the thick, solid rollers of this invention, one heated by electrical induction and the other heated by a cartridge heater.

The solid, thick refractory rollers as seen in FIGS. 1 and 2 can be heated by a variety of means such as electrical induction coils 38 in roller 30 in FIG. 2. Some rollers can be made by compressing refractory particles 40 with induction material particles 42 and sintering such particles together as also seen in roller 30 in FIG. 2. Conductive particles 42 can be incorporated into the particle matrix of the refractory materials to be heated by electrical induction. Roller 32 can have at least one channel 48 defined therein for receipt of at least one heat cartridge 46 therein, such as a ceramic fiber heat cartridge, to heat the roller, but very high temperatures above 1200 degrees C. cannot be reached with electrical heating cartridges but can only be achieved by using induction heating as discussed above. FIG. 1 shows heating of roll 10 by heat beam 18 which can be from a laser or other high heat source such as concentrated infrared beams aimed to impinge directly on a portion of the sidewall of one or both rollers or roller journals 14 and 16 to conduct heat to the roller(s). The materials can also be scanned by such heat beam to increase the temperature of the materials being rolled. The heat beam can be scanned over one or both rollers. An example of such a hot laser can be a $CO_2$ (carbon dioxide) gas laser or a NdYag (neodymium yttrium aluminum garnet) solid state laser. In another embodiment heat can be added to the rollers by directing the heat beam directly on the material to be mixed. The heat beam type heat source can be utilized also in combination with the other roll heating methods discussed above. FIG. 1 also illustrates chamber 20 which can have oxygen removed therefrom which oxygen in some cases can have an adverse reaction on the compounds being mixed. Chamber 20 can also be evacuated to provide an inert environment or can be provided with an inert atmosphere or otherwise provided with any desired reactant gas or vapor.

Many products can be made on the heated rollers of this invention such as, for example, molten glass with triazines such as melem, melan or melon a mixture and aluminum-rich glass which contains a high percentage of aluminum to reduce its brittleness. These glasses also can contain iron and serrium within their alloys as well as, in some cases, nickel and yttrium. Such aluminum-rich glass, which can be mixed on the high-temperature roll mill of this invention is useful as a lightweight construction material in the aerospace field because such glass crystallizes at a relatively high temperature. Fibers, such as ceramic, tungsten or graphite fibers, can also be sheared into the melt on rollers. A larger nip gap adjustment would have to be made to minimize fiber degradation.

Although the present invention has been described with reference to particular embodiments, it will be apparent to those skilled in the art that variations and modifications can be substituted therefor without departing the principles and spirit of the invention.

I claim:

1. A roll mill comprising:

a pair of solid rollers made solely of refractory ceramic material; and means to heat said rollers to a temperature in the range of 500 degrees C. to 4000 degrees C.

2. A roll mill comprising:

a pair of solid rollers made of compressed refractory particles and conduction particles sintered together; and means to heat said rollers to a temperature in the range of 500 degrees C. to 4000 degrees C.

3. The roll mill of claim 1 wherein said rollers are heated by electrical induction coils.

4. The roll mill of claim 2 wherein said rollers are heated by electrical induction coils.

5. The roll mill of claim 1 wherein said rollers are heated by a heat beam.

6. The roll mill of claim 2 wherein said rollers are heated by a heat beam.

7. The roll mill of claim 1 further including at least one heat cartridge embedded within said rollers.

8. The roll mill of claim 2 further including at least one heat cartridge embedded within said rollers.

9. The roll mill of claim 1 wherein said roll mill is operated an atmospherically controlled chamber.

10. The roll mill of claim 2 wherein said roll mill is operated an atmospherically controlled chamber.

* * * * *